US008191936B2

(12) United States Patent
Cole et al.

(10) Patent No.: US 8,191,936 B2
(45) Date of Patent: Jun. 5, 2012

(54) GAMING MACHINE DOOR LATCH

(75) Inventors: Joseph W. Cole, North Las Vegas, NV (US); Edward H. Comfort, North Las Vegas, NV (US)

(73) Assignee: Cole Kepro International, LLC, Las Vegas, NV (US)

( * ) Notice: Subject to any disclaimer, the term of this patent is extended or adjusted under 35 U.S.C. 154(b) by 0 days.

(21) Appl. No.: 12/291,827

(22) Filed: Nov. 12, 2008

(65) Prior Publication Data

US 2010/0117384 A1 May 13, 2010

(51) Int. Cl.
*E05B 15/02* (2006.01)

(52) U.S. Cl. ..... 292/44; 292/341.17; 292/224; 292/121

(58) Field of Classification Search ..... 292/26, 292/30, 95, 109, 129, DIG. 11, DIG. 68, 292/341.17, 44, 49, 47, 50, 54
See application file for complete search history.

(56) References Cited

U.S. PATENT DOCUMENTS

| | | | | |
|---|---|---|---|---|
| 4,799,718 | A * | 1/1989 | Ing | 292/36 |
| 5,224,707 | A | 7/1993 | Martin | |
| 6,112,563 | A | 9/2000 | Ramos | |
| 6,125,673 | A | 10/2000 | Luker | |
| 6,146,274 | A | 11/2000 | Salour et al. | |
| 6,474,758 | B1 | 11/2002 | Hedrick et al. | |
| 6,496,101 | B1 | 12/2002 | Stillwagon | |
| 6,681,604 | B1 * | 1/2004 | Samsel | 70/78 |
| 6,724,303 | B2 | 4/2004 | McGunn et al. | |
| 6,899,626 | B1 | 5/2005 | Luciano et al. | |
| 6,976,919 | B2 | 12/2005 | Cole | |
| 7,070,365 | B1 * | 7/2006 | Blankenship | 408/1 R |
| 7,418,845 | B2 * | 9/2008 | Timothy | 70/100 |
| 2005/0107167 | A1 | 5/2005 | Sasaki | |
| 2006/0012184 | A1 * | 1/2006 | Ottesen et al. | 292/216 |
| 2007/0052251 | A1 | 3/2007 | Hautala et al. | |
| 2008/0265587 | A1 * | 10/2008 | Nakanishi et al. | 292/26 |
| 2009/0019779 | A1 * | 1/2009 | Nakanishi et al. | 49/449 |

FOREIGN PATENT DOCUMENTS

| | | |
|---|---|---|
| JP | 2008-02/2008 | 2/2008 |
| KR | 10-0576080 | 4/2006 |

* cited by examiner

*Primary Examiner* — Kristina Fulton
(74) *Attorney, Agent, or Firm* — Weide & Miller, Ltd.

(57) ABSTRACT

A gaming machine door latch comprises a slide having one or more associated catches, and lock or latch strikes. The slide may be mounted to the gaming machine housing for vertical movement. The catches are mounted to the slide and may be configured to pivot. The strikes are mounted to the door. When the gaming machine door is closed, the catches automatically engage the strikes, thus latching the door. The door may be opened by raising the slide, causing the catches to move out of engagement with the strikes. The latch may include a lock which locks and unlocks the slide.

4 Claims, 2 Drawing Sheets

GAMING MACHINE DOOR LATCH

FIELD OF THE INVENTION

The present invention relates to gaming machines, and particularly to a latching mechanism for a gaming machine door.

BACKGROUND OF THE INVENTION

Gaming machines such as slot, video poker, lottery, keno or bingo machines, are very prevalent. Larger casinos may have many thousands of such machines on their floor. On the one hand, these machines are wagering machines and thus must be kept very secure. For example, tampering with a gaming machine might cause the gaming machine to fraudulently indicate a game win and award winnings. Further, the machines generally accept and/or dispense coins or currency, and access to the interior thereof may result in theft of these monies. As a result, substantial efforts are made to make the gaming machines secure.

At the same time, the machines must be frequently serviced. For example, casino personnel may need to access the interior of a gaming machine to remove a full cash/currency box or to deposit coins to be dispensed as winnings. Casino personnel might also need to perform repairs. Thus, the interior of the gaming machines must be readily accessible for such purposes.

In order to provide access, a gaming machine may be configured with one or more doors. These doors may be opened to permit access to the interior of the machine, and closed to secure the machine. One problem that exists, however, is that standard door latching mechanisms have several drawbacks. A prevalent latching mechanism is a key-operated rotating latch that is moveable between a latched and unlatched position. A drawback to this configuration is that the door can only be latch if it is first completely closed and then the key is rotated so that the latch catches the door. If the door is not completely closed, when the latch is rotated it may not catch the door and though the door may appear secure, it may be opened. To ensure that the door is closed, a technician may swing the door shut swiftly. However, this may cause the door to hit the gaming cabinet with impact, damaging one or more components thereof.

Thus, an improved door latching configuration for a gaming machine is desired.

SUMMARY OF THE INVENTION

The invention is a door latch for a door of a gaming machine and methods of latching and unlatching a gaming machine door.

In one embodiment the door latch comprises a latch slide which is preferably mounted to a cabinet or housing of the gaming machine. The slide is configured to be moved, such as vertically between raised and lowered positions.

One or more catches are mounted to the slide and configured to move with the slide. The catches are configured to engage mating strikes mounted to the door, such as by including a recessed area for accepting a post portion of the strike. In one embodiment, the catches are configured to move up and down, such as by pivoting. The catches may be biased downwardly into a strike "engaging" position.

The door latch further comprises a lock or locking mechanism. The lock may comprise a key-operated cylinder having an arm mounted thereon. Rotation of the cylinder causes the arm to rotate, selectively placing the arm into or out of engagement with a stop on the slide, and thus selectively locking or unlocking the slide for movement.

Latch or lock strikes are associated with the door. The strikes are configured to be engaged by the corresponding catches associated with the slide.

In use, when the door of the gaming machine is closed, the catches impact the strikes associated with the door. The catches pivot or move upwardly. As the door moves further inwardly, the catches are biased downwardly into a position in which they engage the strikes, thus latching the door into a closed position.

A user may insert a key into the lock at a point external to the gaming machine housing. The user rotates the lock, thus causing the arm to move into a locking position, preventing the slide from moving upwardly. At this time, the door is locked in its closed position.

To unlatch the door, the user inserts the key into the lock and rotates the key to move the arm to its unlocked position. The user then raises the slide upwardly. This may be accomplished by lifting upwardly on a pin connected to the slide, the pin extending to the exterior of the gaming machine housing. When the user raises the slide, the catches are moved upwardly out of engagement with the strikes. The door may then be moved to its open position.

Further objects, features, and advantages of the present invention over the prior art will become apparent from the detailed description which follows, when considered with the figures provided herein.

DETAILED DESCRIPTION OF THE INVENTION

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

In general, the invention comprises a gaming machine door latch and method of latching and unlatching a gaming machine door.

Figure 1:
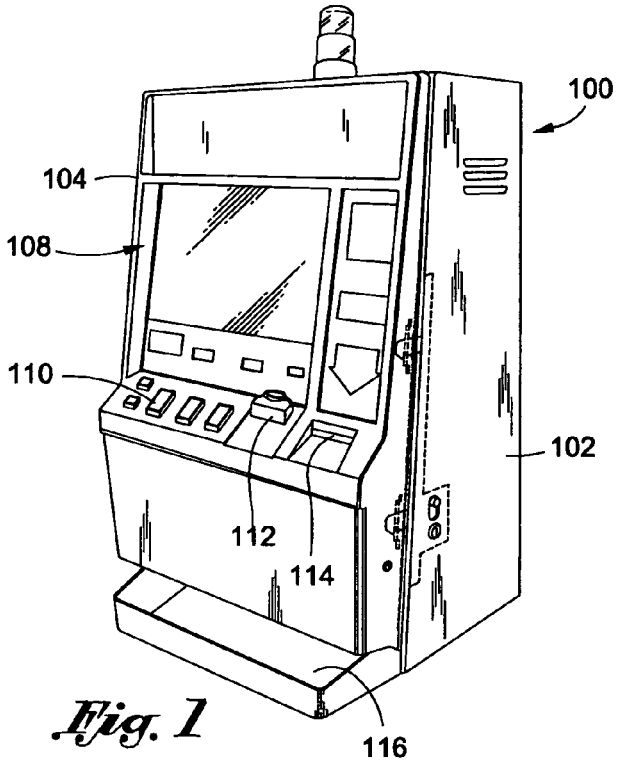
FIG. 1 illustrates a gaming machine having a door and door latch in accordance with the present invention.

FIG. 1 illustrates one embodiment of a gaming machine or device 100 to which the invention is applicable. In one embodiment, the gaming machine 100 is a wager-based gaming machine configured to present one or more games to a player which offers the possibility of an award of winnings. Of course, the gaming machine 100 could be configured to present games or amusing activities based upon payment and either not award winnings or offer the opportunity for prizes or the like.

In one embodiment, the gaming machine 100 defines a generally enclosed interior space for housing one or more components. As illustrated, the gaming machine 100 generally comprises a housing or cabinet 102 for supporting and/or enclosing various components required for operation of the gaming machine. In the embodiment illustrated, the housing 102 includes a door 104 located at a front thereof, the door capable of being moved between an open position which allows access to the interior 106 (see FIG. 2), and a closed position in which access to the interior is generally prevented. The configuration of the gaming machine 100 may vary. In the embodiment illustrated, the gaming machine 100 has an "upright" configuration. However, the gaming machine 100 could have other configurations, shapes or dimensions (such as being of a "slant"-type or other configuration as is well known to those of skill in the art). It is noted that the configuration of the door 104 may vary, such as dependent upon the configuration of the gaming machine 100. For example, relative to a "slant" or "bar-top" type machine, the door 104 may be configured substantially as a lid. Further, the size and shape of the door may vary. In some embodiments, a gaming machine may also have more than one door.

The gaming machine 100 preferably includes at least one display device 108 configured to display game information. The display device 108 may be a mechanical, electro-mechanical or electronic display, such as one or more rotating reels, a video display or the like. When the display device 108 is an electronic video display, it may comprise a cathode ray tube (CRT), high resolution flat panel liquid crystal display (LCD), projection LCD, plasma display, field emission display, digital micro-mirror display (DMD), digital light processing display (DLP), LCD touchscreen, a light emitting display (LED) or other suitable displays now known or later developed, in a variety of resolutions, sizes and formats (e.g. 4:3, widescreen or the like). The display 108 may be capable of projecting or displaying a wide variety of information, including images, symbols and other indicia or information associated with game play, game promotion or other events.

The gaming machine 100 may be configured to present a wide variety of games. These may include games in Class III, such as video poker games, slot-type games, and blackjack or other card, dice or various other games now known or later developed, as well as games in Class II, including central determinant games such a video lottery, bingo and bingo-based games, and other games now known or later developed. The games may also be skill based or include one or more skill components. In one embodiment, certain game outcomes may be designated as winning outcomes. Awards may be provided for winning outcomes, such as monetary payments (or representations thereof, such as award of credits), prizes or the like. As is well known in the art, the number of winning outcomes may vary dependent upon the desired payout or winning percentage offered to the players as compared to wagers that are retained by the gaming establishment.

The gaming machine 100 may include one or more player input devices 110 (such as input buttons, a touch-screen display, joystick, touch-pad or the like) that may be utilized by the player to facilitate game play. The gaming machine 100 may include a coin accepting mechanism 112 for accepting coins and/or a currency or bill acceptor 114 for accepting cash or paper currency. It is also contemplated that other mechanisms may be provided for accepting a wager, such as credit card, ticket readers or input devices whereby a player may have funds paid from a remote account.

In one preferred embodiment, the gaming machine 100 includes a microprocessor or controller (not shown) for controlling the gaming machine, including receiving player input and sending output signals for controlling the various components of the machine 100 (such as generating game information for display by the display 108). The controller may be arranged to send signals for determining winning combinations and to cause a display to display winning amount information. In addition, the controller is preferably arranged to determine if a round of game play has resulted in a win, and if so, the amount to be paid to the player for that win.

The gaming machine 100 may include a means for paying a player any winnings accumulated during game play. For example, a "cash out" button may be provided for permitting a player to be paid the winnings or redeeming any credits initially paid into the gaming machine 100. The term "cash out" is used herein to define an event initiated by the player wherein the player receives a number of coins or currency that is equivalent to the value of the player's accrued credit base. Typically when a player cashes out, the player receives either a paper currency voucher or currency in the form of a coin disbursement. If the player decides to receive a coin disbursement, the gaming machine 100 may activate a coin hopper or coin handling device (not shown) which physically counts and delivers the proper number of coins to the player. The coin handling device is commonly configured to transport coins from a supply source (hopper or bin filled with coins) to a coin tray 116 or payout receptacle where the player physically receives the coins. The player might also elect to cash out by having a ticket or other media dispensed, such as via a printer.

The gaming machine 100 may be configured as a stand-alone device or be in communication with one or more external devices at one or more times. For example, the gaming machine 100 may be configured as a server based device and obtain game code or game outcome information from a remote server. The gaming machine 100 may also communicate with one or more gaming servers (not shown). These one or more gaming servers may be configured to perform accounting, player tracking, bonusing, game generation, promotions or other functions.

One embodiment of the invention comprises a door latch 200. Preferably, the door latch or latching mechanism 200 is configured to automatically latch a door and permit the door to be secured in a closed or locked condition.

Figure 3:
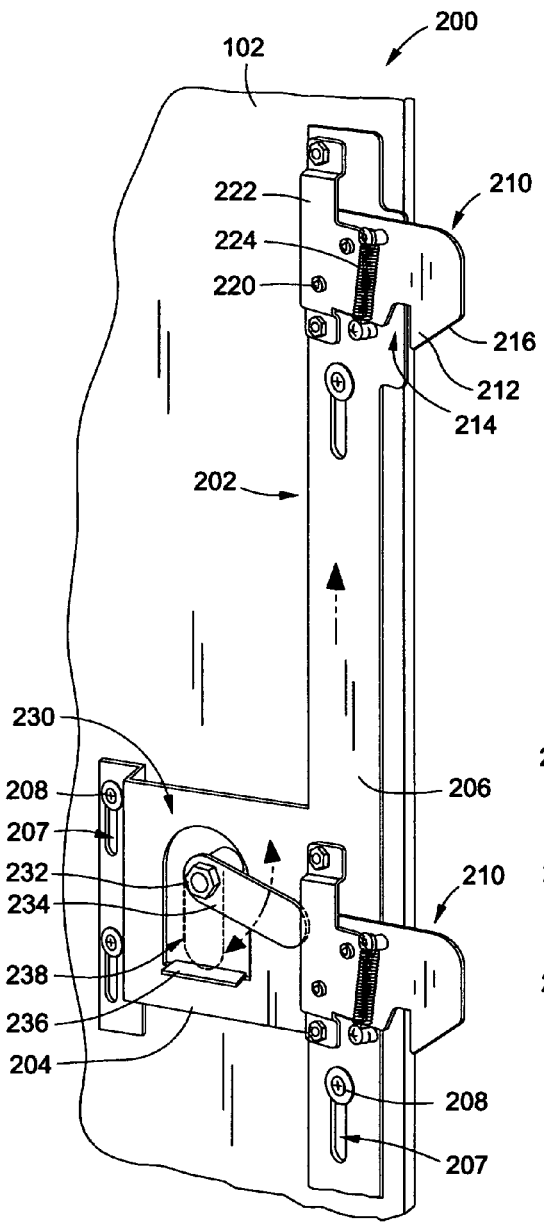
FIG. 3 illustrates a portion of a door latch in accordance with the present invention, the door latch illustrated in a first position.

FIG. 3 illustrates one embodiment of the invention. As illustrated, the latch 200 comprises a latch slide 202. The slide 202 preferably comprises a moveable body. In one embodiment, as illustrated, the slide 202 is mounted to an interior of a side portion of the gaming machine cabinet 102. The slide 202 may have various shapes and sizes, depending upon the particular application, including the size and shape of the gaming machine.

As illustrated, the slide 202 has a lock portion 204 and a latch mount portion 206. The slide 202 may be formed as a unitary element or from a number of elements. For example, the slide 202 may be formed from steel plate.

As indicated, the slide 202 is preferably configured to be movable relative to the gaming machine housing. In one embodiment, the slide 202 defines one or more slots 206 for accepting corresponding pins 208. In a preferred embodiment, the slots 206 extend vertically, permitting the slide 202 to be moved in the vertical direction (i.e. raised and lowered). Of course, the slide 202 might be mounted for movement in a variety of fashions now know or later developed. For example, the slide 202 might be mounted to a track formed in or connected to the gaming machine housing 102.

Importantly, the latch 200 further comprises at least one catch 210. Preferably, each catch 210 is mounted to the slide 202 for movement therewith.

Figure 5:
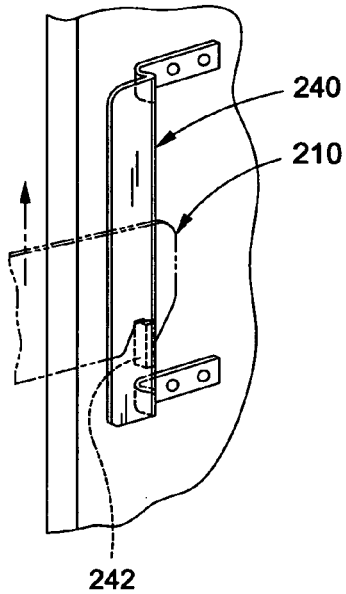
FIG. 5 illustrates a door mounted strike of a door latch in accordance with an embodiment of the invention.

In one embodiment, each catch 210 is configured to engage a strike or dock associated with the door (see FIG. 5). As illustrated, each catch 210 may have a nose or extension 212 which is located forward of a slot or depression 214. In one embodiment, a lower surface 216 of the nose 212 is sloped or slanted, preferably downwardly moving inwardly towards the slot 214.

In one embodiment, each catch 210 is movably mounted to the slide 202. As illustrated, a rear portion of the catch 210 may be mounted by one or more pins 220 to a support 222. The mounting of the catch 210 to the support 222 permits the catch 210 to rotate or pivot, thus permitting the nose 212 to move up and down. As illustrated, the support 222 is preferably in turn mounted to the slide 202, so that each catch 210 moves with the slide. Of course, the catches 210 might be mounted directly to the slide.

As indicated, each catch 210 can move up and down. Preferably, each catch 210 can move between a raised position and a lowered position. As illustrated, means are provided for biasing each catch 210 towards the lowered position. This means may comprise a coil spring 224. As illustrated, the coil spring 224 has one end connected to the catch 210 and another end connected to the slide 202 (at a point below the catch 210). Of course, other biasing means might be utilized, such as other types of springs, elastic members or the like. In one embodiment, downward movement of the catch 210 might be limited by a stop, such as one of the pins to which the spring 224 is connected.

Figure 2:
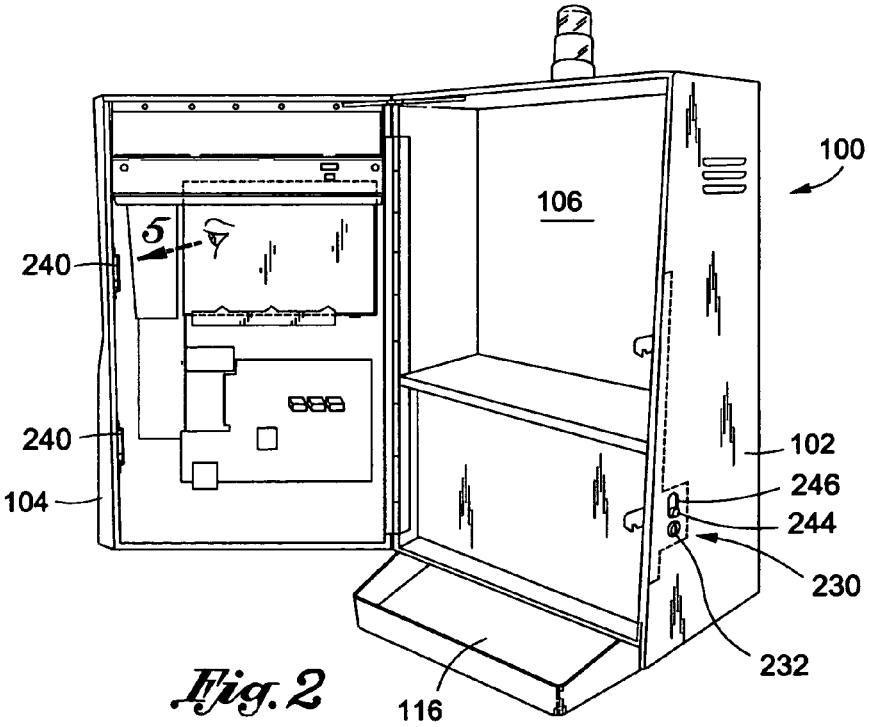
FIG. 2 illustrates the gaming machine of FIG. 1 with a door thereof in an open position.

The latch 200 includes a lock 230 for selectively locking the slide 202. In one embodiment, the lock 230 comprises a key-operated cylinder 232, an arm 234, and a stop 236. The cylinder 232 may include a key-accepting slot which is accessible from the exterior of the gaming machine, as best illustrated in FIG. 2. A shaft portion of the cylinder 232 is located in the interior of the gaming machine. The arm 234 is connected to the shaft portion of the cylinder 232. The cylinder 232 is preferably selectively rotatable between at least first and second positions via use of a mating key. Movement of the cylinder 232, in turn, moves the arm 234.

As illustrated, a first end or portion of the arm 234 is connected to the cylinder 232. The opposing end or portion of the arm 234 is configured to selectively engage the stop 236. In one embodiment, the stop 236 comprises a portion of the slide 202. As illustrated, an aperture 238 is defined in the slide 202. The cylinder 232 and arm 234 are located in the aperture. The stop 236 extends outwardly from the slide 202 and is located in the same vertical plane as the arm 234. In this manner, the arm 234 and stop 236 can contact one another.

As illustrated in FIG. 5, the latch 200 further comprises a strike 240 corresponding to each catch 210. Each strike 240 is configured to engage the mating catch 210 for latching the door, as detailed below. The strikes 240 may have a variety of configurations, depending in part upon the configuration of the mating catch 210. In a configuration in which the catch 210 has a sloped nose and recess, as illustrated in FIG. 3, the strike 240 preferably defines a post or pin which extends outwardly for engagement with the recess of the catch 210.

In one embodiment, the strike 240 has a "U"-shape, with a pair of legs and a central connecting portion. Preferably, the central connecting portion is offset from the legs in a different plane by post portions 242. The legs are configured to mount to the door 104 of the gaming machine. Preferably, the strikes 240 are mounted in locations on the door 104 for engagement by the mating catches 210 associated with the cabinet portion of the gaming machine 100. Of course, the strikes 240 might have other configurations. For example, instead of being separate elements connected to the gaming machine door, the strikes might be defined by or be a portion of the door. For example, the strikes might comprise pins or posts which are defined by the door.

In order to permit a user to effectuate movement of the slide 202 from the exterior of the gaming machine, a pin 244 may be connected to the slide 202. The pin 244 may extend through a slot or aperture 246 in the gaming machine housing 102, as best illustrated in FIG. 2. In this manner, when a user raises the pin 246, the slide 202 is moved upwardly (assuming that such movement is not prevented because the slide is locked by the lock).

Figure 4:
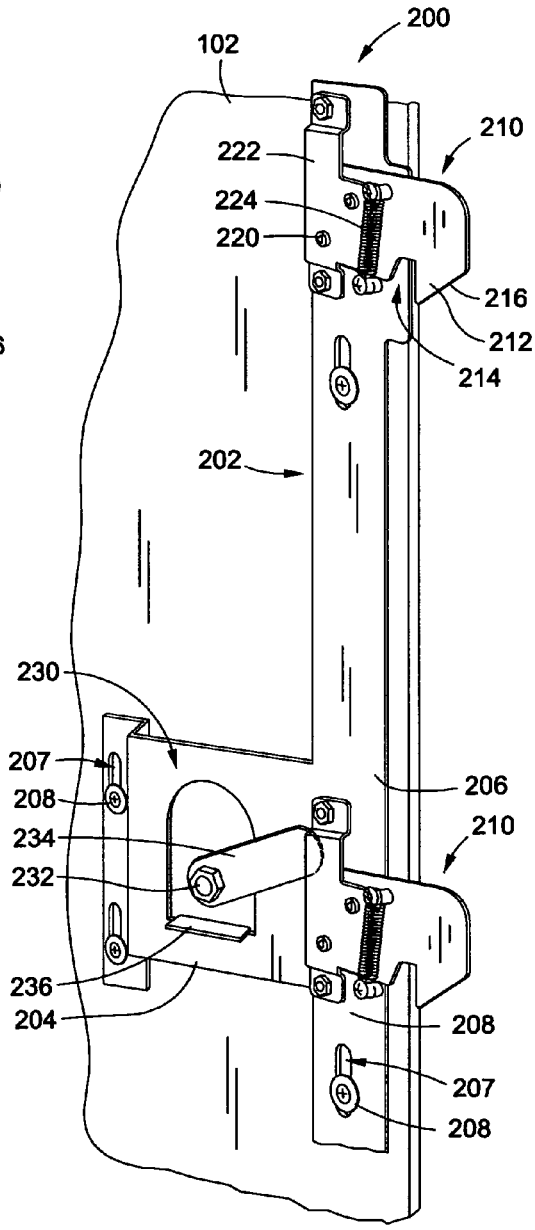
FIG. 4 illustrates a portion of the door latch in accordance with the present invention, the door latch illustrated in a second position.

Use of the latch 200 of the invention will now be described with reference primarily to FIGS. 3 and 4. First, when the door 104 is in its closed and latched position, the door 104 is closed against the housing 102 of the gaming machine 100. The slide 202 is in its lower position, as illustrated in FIG. 3, whereby the catches 210 engage the mating strikes 240. In particular, the catches 210 extend over a portion of their respective strikes 240, whereby the post or pin portions thereof are located in the recess 214 of the catch 210. At this time, the door 104 is maintained in a closed position. In particular, outward force applied to the door will not open the door because the catches 210 engage the strikes 240.

In addition, the latch 200 is locked, thus preventing unlocking of the latch 200. In particular, the arm 234 is rotated downwardly to the position illustrated in dotted lines in FIG. 3. In this position, the arm 234 engages the stop 236, preventing upward movement of the slide 202. Because the slide 202 can not be moved upward, the catches 210 can not be moved out of engagement with the strikes 240 on the door 104 of the gaming machine.

In the event a party wishes to open the door, they must unlock and unlatch the latch 200. First, the user unlocks the latch 200. The user inserts a key into the key slot of the cylinder 232 at the exterior of the gaming machine 100. The user rotates the key to rotate the cylinder 232, thus moving the arm 234 in the direction illustrated in FIG. 3. This moves the arm 234 out of engagement with the stop 236.

The user can then raise the slide 202 so that the catches 210 move out of engagement with the strikes 240. In particular, the user pulls upwardly on the lift pin 244 at the exterior of the gaming machine 100 (see FIG. 3). This moves the slide 202 upwardly, as illustrated in FIG. 4. When the slide 202 moves up, the catches 210 rise above the mating strikes 240. The user can then pull the door 104 to an open position to gain access to the interior of the gaming machine.

When the user wishes to close the door 104 of the gaming machine 100, the user can swing the door shut. When the door swings shut, the nose 212 of each catch 210 impacts its corresponding coupling 240. The catches 210 then pivot upwardly as the sloped portion 216 of each nose 212 moves over its corresponding strike 240. Once the nose 212 of each catch 210 passes the post portion 242 of the strike 240, the catches 210 are biased downwardly so that the post portions 242 are caught in the recessed portion of each catch 210. The door is then latch into a closed position.

The latch 200 may then be locked by rotating the cylinder 232, such as with a key. This then again prevents the latch 200 from being moved into an unlatched position.

The latch mechanism of the invention may have various configurations. As indicated, the slide may preferably be mounted to the gaming machine housing, while the strikes are mounted to the door. However, the slide might be mounted to the door and the strikes mounted to the cabinet or housing. When the slide is mounted to the gaming machine housing, it preferably mounted so that the catches extend outwardly towards the door. The strikes are mounted in corresponding positions on the door, whereby the catches may engage the strikes.

The gaming machine might include more than one door, and one or more of the doors might have such a latch associated therewith.

The latch mechanism might include multiple catches, and their location might vary. For example, very large doors might be latched with a latch comprising three or more catches and mating strikes.

Other types of locks or locking mechanisms might be utilized to selectively control the slide.

The invention has a number of advantages. First, a latch is provided for a gaming machine door which is configured to automatically latch the door into a closed position simply by closing the door. As indicated, when the door is shut, the latch automatically latches the door shut. In this regard, the latching mechanism may be referred to as a "slam latch" since brisk closing or "slamming" of the door results in automatic latching of the door. It is noted that this represents a significant departure from current door latches wherein closing of the door does not effectuate any latching. Instead, latching only occurs if the door is first closed and then while closed, a locking member is separately and manually moved into engagement with the door.

Another advantage of the invention is a latch configuration which permits the latch to be maintained in a locked position. This prevents the door from being unlatched, except by authorized personnel.

Another aspect of the invention is a latch which includes multiple latch points which are configured to be simultaneously activated/actuated. In particular, multiple catches can be utilized to engage the door at various positions so as to ensure that the door is securely latched. In addition, these catches are simultaneously activated by movement of the slide, thus avoiding the need to separately actuate multiple latches.

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. A latch for selectively latching a door of a gaming machine to a housing thereof comprising:

a slide movably mounted to said housing for movement between a raised position and a lowered position;

at least two catches each having a rear portion and a nose portion and a strike engaging recess between said rear portion and said nose portion, said catches rotatably mounted on said slide, whereby each catch travels with said slide between first and second locations when said slide is moved between its raised and lowered positions and whereby at least said nose portion of each catch may move between a raised and a lowered position by each catch rotating about its mount on said slide, even when said slide is not moved;

at least one biasing member corresponding to each catch and configured to bias the nose portion of its corresponding catch into its lowered position;

a strike corresponding to each catch, each strike mounted to said door and having a portion configured to be accepted into said strike engaging recess of its corresponding catch;

a lock mounted to said housing, said lock in a locked state preventing said slide from being moved between said lowered position and said raised position and said lock in an unlocked state permitting said slide to be moved between said lowered position and said raised position;

whereby when said lock is in said unlocked state, said slide may be moved upwardly from its lowered position to its raised position, thus causing said catches mounted thereon to travel upwardly with said slide from a first location in which said strikes are located in said strike engaging recesses of said catches to a second location in which said strikes no longer engage said strike engaging recesses of said catches, thus permitting said door to be moved from a closed to an open position;

whereby when said lock is in an unlocked state and said slide is in its lowered position and said door is moved from said open to said closed position, said nose portion of each catch strikes said strike corresponding thereto, each catch rotating about its mount on said slide though said slide does not move, permitting said nose portion of each catch to rotate upwardly over said strike corresponding thereto until said strikes are located in said strike engaging recesses of said catches; and whereby once said door is in said closed position and said lock is placed in said locked state, said slide is prevented from being moved upwardly, thus locking said door in said closed position.

2. The latch in accordance with claim 1 wherein said lock comprises a rotatable cylinder having an arm connected thereto, said arm configured to selectively engage said slide upon rotation of said cylinder.

3. The latch in accordance with claim 1 wherein each strike comprises a post for location in said recess in said corresponding catch.

4. The latch in accordance with claim 1 wherein said means for biasing comprises at least one spring.

* * * * *